United States Patent [19]

Thomas

[11] Patent Number: 4,768,301

[45] Date of Patent: Sep. 6, 1988

[54] MAGAZINE HOLDER AND MAGAZINE SUITABLE FOR RIGHT AND LEFT HANDED RELEASE

[75] Inventor: Jörn Thomas, Vorstadt, Switzerland

[73] Assignee: SIG Schweizerische Industrie-Gesellschaft, Neuhausen am Rheinfall, Switzerland

[21] Appl. No.: 59,800

[22] Filed: Jun. 9, 1987

[30] Foreign Application Priority Data

Jun. 11, 1986 [CH] Switzerland ..... 2377/86

[51] Int. Cl.[4] ..... F41C 25/06

[52] U.S. Cl. ..... 42/7

[58] Field of Search ..... 42/7

[56] References Cited

U.S. PATENT DOCUMENTS

| | | | |
|---|---|---|---|
| 1,397,109 | 11/1921 | Pedersen | 42/7 |
| 4,236,337 | 12/1980 | Beretta | 42/7 |
| 4,326,353 | 4/1982 | Ludwig et al. | 42/7 |
| 4,449,311 | 5/1984 | Giragosian | 42/7 |
| 4,574,509 | 3/1986 | Smith | 42/7 |
| 4,599,818 | 7/1986 | Fedora et al. | 42/7 |

*Primary Examiner*—Charles T. Jordan

*Attorney, Agent, or Firm*—Lewis H. Eslinger; Jay H. Maioli

[57] ABSTRACT

An important factor in firearms suitable for combat is the capability to permit replacing the magazine with one hand, that is, to permit the user to eject an emptied magazine by releasing it with the shooting hand and permitting it to drop out automatically, so that a full magazine can be inserted with the free hand. To accomplish this, a latch mechanism is arranged in a through hole formed transversely to the magazine opening and to the longitudinal axis of the barrel of the gun and includes two positive detent latches in a concave or arched portion, the detents being separated by a central groove. The detents have an outer arched or curved surface and on the inside provide straight walls for the groove, in this way a straight magazine can displace the latch axially. The magazine has two pairs of recesses in a rounded leading surface that are arranged so that the two detents seat in the recesses, thereby to accurately support the magazine in two dimensions. The latch mechanism is in one piece and is retained by a stop plate held by the hand grips of the gun and by a spring loaded stop mechanism that cooperates with a slot in the gun frame to permit movement of the latch assembly in one direction but to limit its travel in another direction.

9 Claims, 2 Drawing Sheets

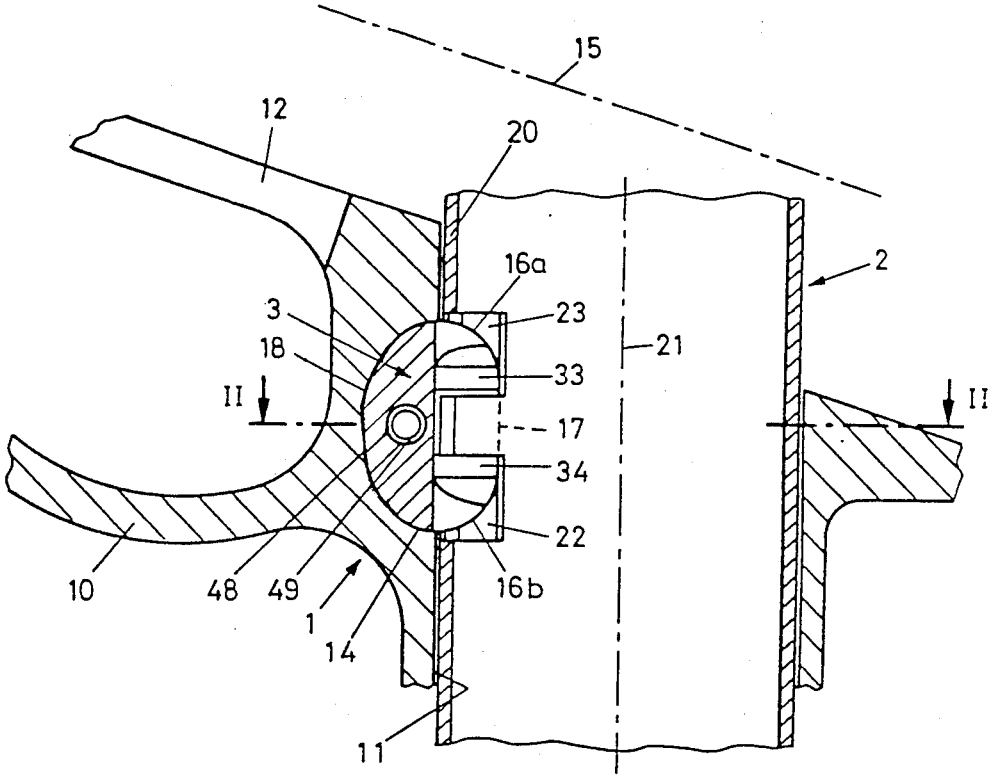
Fig. 2
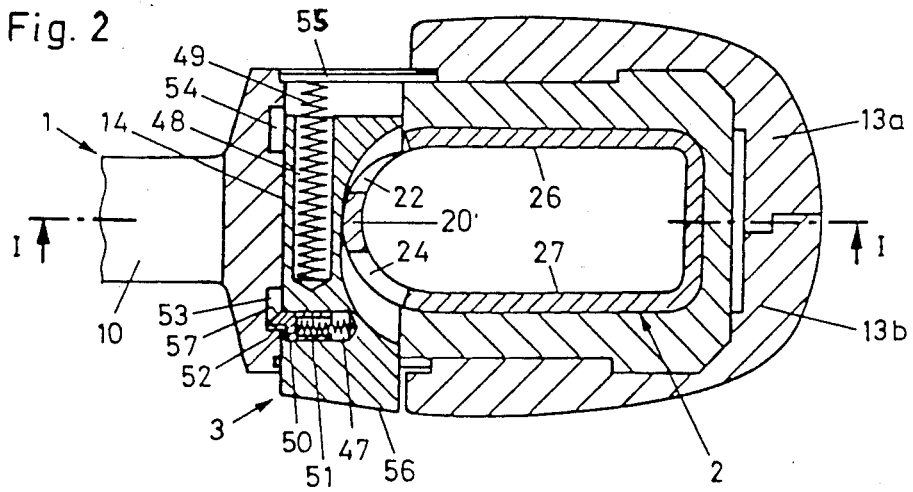

MAGAZINE HOLDER AND MAGAZINE SUITABLE FOR RIGHT AND LEFT HANDED RELEASE

BACKGROUND OF THE INVENTION

1. Field of the Invention

This invention relates generally to a system for holding a magazine in a firearm and, more particularly, to a magazine system that is adaptable for either right-handed or left-handed release of the magazine from the firearm.

2. Description of the Background

In the type of firearm referred generally to as an automatic firearm, that is, not a revolver or lever-action, there is typically provided a release mechanism for releasing a spent magazine. The cartridges are arranged in a stack in the magazine and are pushed upwardly by a spring into the breech of the firearm for automatic firing. Such release mechanisms are preferably actuable by the thumb of the user, because when such firearms are utilized in a combat situation it is of utmost importance that a spent magazine can be ejected or released by the shooting hand so that the free hand can quickly insert the full magazine to continue the firing of the gun.

Various kinds of magazine release mechanisms are known, and one kind of mechanism that has been proposed permits the magazine to be released from either side of the handle. That is, the release mechanism extends sufficiently on either side of the gun so that it can be actuated by the right thumb or the left thumb depending upon the handedness of the user. Examples of this kind of release mechanism are shown in German patent DE No. 29 05 770 and in British patent GB No. 2,137,321. A principal problem that has been found with this type of release mechanism, especially when such mechanisms are intended for pistols used in combat environment is that when the pistol is pulled from the holster using the shooting hand the pin catches and plates on the holster can catch on one or both of the release mechanisms and the magazine is released and falls out of the firearm. This of course is a undesirable situation since it leaves the firearm with only a single cartridge in the breech, which can be dangerous to a soldier's life in combat.

The second kind of known magazine release is one in which the magazine holder is designed so that the weapon can be used and the magazine released with either the right hand or the left hand provided that some disassembly and rearrangement of the parts is performed. This disassembly is permitted because it is highly improbable that the same weapon will be used by a left-handed person and a right-handed person with only a brief interval between the two uses. For example, if the weapons are stored in an armory or weapons room and are then distributed for use without selection, there must be a certain amount of preparation necessary before use, such as cleaning, loading and the like, which will permit the magazine release mechanism to be changed over to the appropriate side of the gun. An example of this kind of reversible magazine latch is shown in U.S. Pat. No. 4,449,311, in which a latch that is movable transversely relative to the longitudinal axis of the magazine is arranged in a through hole formed in the handle of a pistol. This latch has a domed latch button at one end that protrudes beyond the surface of the frame, and the latch is retained in the through hole by a threaded element. More particularly, the body of the latch is provided with an internal thread that has threaded thereinto a threaded collar that seats in a recess in the handle to retain the sliding latch in the frame. In order to limit the extent of travel of the moveable latch element, a pin is fitted radially in the latch element and cooperates with a slot formed in the frame of the pistol. Thus, the moveable portion slides back and forth within the body to an extent determined by the pin. A detent is provided to interact with one of two slots formed in the magazine. The latch mechanism can be disassembled, removed, and then reinserted from the opposite side into the through hole, in order to change the orientation of the domed release button.

Although this reversible magazine latch consists of only two subassemblies, these two subassemblies are complicated and have pins and detents and the like extending therefrom that make it difficult to easily disassemble and reassemble the latch mechanism. For example, the outer body is unthreaded from the collar and the moveable element and the two frame pieces are removed from the opposite directions, then upon reassembly the moveable element must be inserted not only into the through hole in the frame but then it also must be positioned inside of the outer body, which has also been reinserted into the through hole. Moreover, it is possible to introduce only slanted magazines without a trigger top with such a construction as known heretofore.

OBJECTS AND SUMMARY OF THE INVENTION

Accordingly, it is an object of the present invention to provide a reversible magazine latch system that can be used either right handed or left handed and that can eliminate the above-noted defects inherent in the prior art.

Another object of the present invention is to provide a magazine holder by which both straight and slanted magazines can be retained in the appropriate recess in the firearm, and that can be retained therein by only pushing the magazine into the recess.

A further object of the present invention is to provide a reversible magazine latch system in which the operable end of the latch element does not protrude a great extent beyond the outer surfaces of the handle and in which the latch element need not be totally disassembled in order to change the orientation from left hand to right hand.

In accordance with an aspect of the present invention, the latch element is formed in one piece as a single, generally cylindrical, form that has a specially provided concave portion that is adapted to cooperate with a rounded, front portion of the magazine and that has two stop shoulders that extend into the rounded concave portion that cooperate with two corresponding slot-like recesses in the magazine. In changing the orientation of the latch element it is necessary only to disassemble partially the handle or hand grips of the firearm to remove a stop plate and then slide the latch element from a through bore at the location previously occupied by the stop plate and then reposition it in the opposite direction, arrange the stop plate on the opposite side, and resecure the hand grips.

The above and other objects, features, and advantages of the present invention will become apparent from the following detailed description of illustrative embodiments thereof to be read in conjunction with the accompanying drawings.

BRIEF DESCRIPTION OF THE DRAWINGS

FIG. 1 is a side elevational view in cross section taken along line I—I in FIG. 2 of a portion of a firearm having a magazine introduced therein;

FIG. 2 is a top plan view in cross section taken along section line II—II of the firearm shown in FIG. 1;

DETAILED DESCRIPTION OF THE PREFERRED EMBODIMENTS

Figure 5:
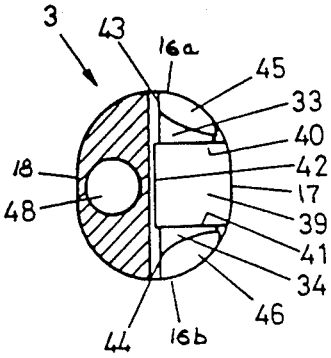
FIG. 5 is side elevational view of the latch element of FIG. 3.

In FIG. 1, a portion of the frame 1 of an automatic firearm is shown having a trigger guard 10 and a magazine housing 11, along with a slot opening 12 for the trigger lever. A magazine 2 is inserted in the housing 11, however, only a portion of that magazine housing is shown in FIG. 1. The firearm frame 1 is provided with handle shells or hand grips 13*a*, 13*b*, which are attached to frame 1 in a conventional fashion, for example, using screws or clips. The conventional spring and cartridge support of magazine 2 form no part of the present invention and thus are not shown in the interest of clarity. In that regard, the latch device 3 that retains the magazine 2 according to the present invention is shown in an assembled condition in FIGS. 1 and 2 and is shown all by itself in FIGS. 3–5. Latch element 3 forming the inventive magazine holder resides in a transverse bore 14 formed in firearm frame 1 and is arranged perpendicularly relative to the longitudinal axis 21 of magazine 2 and also perpendicularly to the longitudinal axis 15 of the barrel of the firearm. As shown in FIGS. 1 and 5 the magazine holding latch element 3 is slightly oval or elliptical in cross section and has two semicircular surfaces 16*a*, 16*b* each being respectively connected with a generally flat or straight portion 17, 18. The magazine latch element 3 is a unitary, one-piece cylinder with a cross section that is generally oval, as shown in FIG. 5, for example. The oval cross section is somewhat exaggerated in FIG. 1, however, it should be elliptical to the extent that it can rotate or be displaced to permit the upper edge of magazine 2 to ride over detents 33 and 34.

Figure 3:
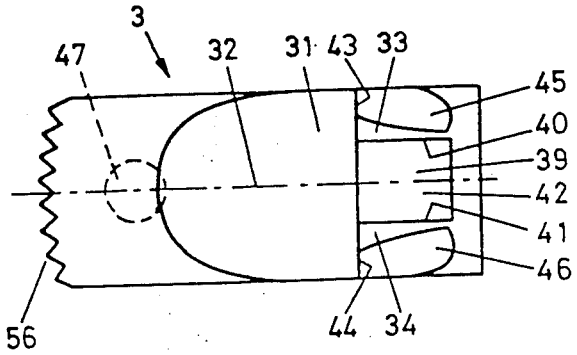
FIG. 3 is a front elevational view of a latch element according to an embodiment of the present invention for use in the firearm of FIG. 1.
Figure 4:
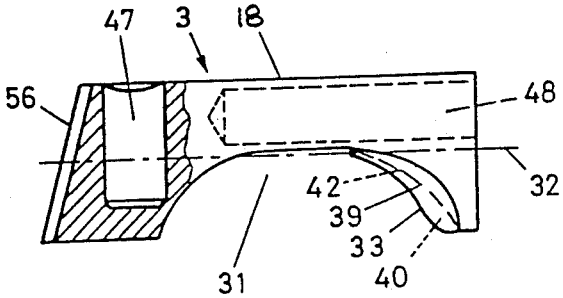
FIG. 4 is a top plan view of the latch element of FIG. 3.

More specifically, in FIG. 5 a concave, cylindrical recess 31 is formed in side 17 of latch element 3, with the axis of that cylindrical, concave recess 31 lying perpendicularly to the plane of the axis 32 of the latch 3. As shown in FIGS. 3 and 4, concave recess 31 is displaced axially from the middle of the body of the latch element 3 and is symmetrical about a central plane through axis 32. Arranged above and below that central plane on axis 32 are two axial stop shoulders or detents 33, 34, which are separated one from another by a central groove 39. As shown more clearly in FIGS. 3 and 5, groove 39 has flat side walls 40, 41 that are arranged substantially parallel to each other as well, as parallel to the longitudinal axis 32 of latch element 3. Similarly, groove 39 is formed with a curved base wall 42, which is generally at right angles to sidewalls 40, 41. Curved base wall 42 forms part of the concave recess 31 and, in that regard, FIG. 5 shows concave arched surfaces 45, 46 that are formed between stop shoulders 33, 34 and edge areas 43, 44, respectively.

In the portion of latch element 3 that does not contain concave recess 31 a longitudinal blind bore 48 is formed off center of latch element 3 and a second blind bore 47 is substantially radially arranged in a portion of latch element 3 that also does not contain concave recess 31. A coil compression spring 49 is arranged within first blind bore 48 and provides a force against which latch element 3 is moved to release magazine 2. Arranged in second blind bore 47 is a latch or keeper element that operates to limit the extent of travel of latch element 3 in the outward direction regardless of the particular orientation, that is, it limits the extent of travel from the right side or the left side of frame 1. More specifically, the keeper consists of a detent element 50, which has a stop surface 52 that is biased outwardly relative to latch element 3 by means of a second compression spring 51 residing in bore 47. Detent 50 cooperates with one or the other of slot-like grooves 53 and 54 that are formed in frame 1 at locations symmetrical to the central plane of the handle 13*a*, 13*b*, on which axis 15 of the barrel also lies. Of course, detent 50 cooperates only with one of slots 53, 54 at any one time and, as shown in FIG. 2, detent 50 can only move within slot 53. Latch element 3 is retained within bore 14 in frame 1 in one direction by means of stop surface 52 of detent 50 hitting a wall of slot 53 and, in that regard, spring 49 is forced against a support plate 55 to bias latch element 3 in the outward direction and to maintain contact between the impact or stop surface 52 and the wall of slot 53. Stop plate 55 is retained in a recess in frame 1 by hand grip 13*a* or 13*b* overlapping a portion of stop plate 55. Thus, by action of compression spring 49 pressure is exerted on latch element 3 to move it towards its outward or end position to be available for actuation by the user of the weapon. Actuation surface 56 of latch element 3 can be arranged to be in alignment with an outer surface of the appropriate hand grip 13*a*, 13*b* when impact surface 52 is against an outer wall of slot 53 or slot 54, whereby there are no elements projecting beyond the overall outer surface of the weapon that could catch on the holster.

According to the present invention the operations required to reverse the side of actuation of latch element 3 are quite simple relative to the devices known heretofor and no blind alignment of parts is required and no complicated mechanical operations are required. In operation then, in preparation for reversing latch element 3 for actuation by the other hand it is necessary only to remove and reposition stop plate 55. As shown in FIG. 2, for example, stop plate 55 is retained on either side of frame 1 by hand grip or handle shell 13*a*, 13*b* and once such handle shell is loosened and moved out of the way stop plate 55 can be removed and the latch element 3 can be pushed through hole 14 formed in frame 1. Referring to FIG. 2, the direction of movement of latch element 3 once the support plate 55 has been removed is seen to be upward. Detent 50 will not oppose this motion because surface 57 that is arranged opposite impact surface 52 is slanted and, thus, upon interaction with a wall of slot 52 or 53 slanted surface 57 will simply force spring 47 into compression and cause the detent 50 to reside further in bore 47.

To reinstall latch element 3 it is only necessary then to reposition stop plate 55 on the opposite side by placing it in its recess and fastening down handle shells 13*a*, 13*b*. Latch element 3 is then reinserted into hole 14 with spring element 49 being first and slanted surface 57 will simply slip over the walls of slots 53, 54. Spring 49 will hit stop plate 55 and bias latch element 3 so that impact surface 52 will hit a wall of one or the other of slots 53, 54 to thereby retain the slidable latch element 3 within bore 14.

Not only does this operation provide a simple and easy operation for changing the magazine holder and release mechanism from one side to another, but also because no fitting together of individual parts is required, the change-over operation can be accomplished without a well-lighted workroom. Also latch element 3 provides a very positive retention of magazine 2 in housing 11.

Figure 6:
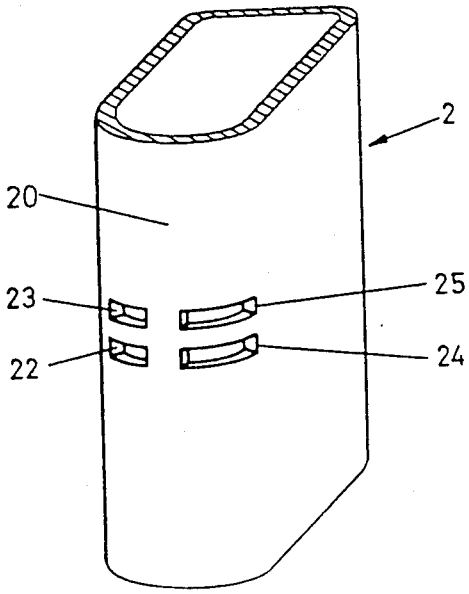
FIG. 6 is a perspective of a portion of the magazine that is retained using the latch element shown in FIGS. 3–5.

Turning FIG. 6, magazine 2 is provided with two pair of slots 22, 23 and 24, 25 that are arranged substantially symmetrically relative to a central plane of magazine 2 at a front portion 20 thereof that is typically rounded. This rounded front portion 20 and the position of slots 22, 24 is also shown clearly in FIG. 1. Thus, upon driving magazine 2 into magazine housing 11, rounded front edge 20 of magazine 2 first contacts lower stop shoulder 34 of latch element 3 (see FIG. 3). Latch element 3 is then forced upwardly and rotated slightly, in the orientation of FIG. 1, by the pressure of magazine 2 against curved, concave surface 46, and it will be retained in that position until both detents 33 and 34 latch into corresponding slots 22, 23, as shown in FIG. 1, for example. When latch element 3 has been reversed and is on the opposite side, relative to the orientation of FIGS. 1 and 2, for example, detents 33, 34 will latch into slots 24, 25, respectively.

When replacing a spent magazine 2, a light pressure on actuating surface 56 is sufficient to move latch element 3 against the force of spring 49 and to disengage detents 33 and 34 from the slots 22, 23 or 24, 25 in magazine 2 so that magazine 2 can fall out under force of gravity. A new magazine can have been already loaded and held in the free hand so that it can be pushed into magazine housing 11 without having to make any further contact with actuating surface 56 of latch element 3. Thus, because spring 49 and detent 50 retained within their respective blind bores, that is, they will not fall out under their own weight, it is necessary only to handle one element during the changing of the actuation side once stop plate 55 has been moved to the appropriate side. Furthermore, by providing the curved concave surfaces 45 and 46 in latch element 3 straight magazines of the kind having only one cartridge in series can be introduced just as easily as the slanted magazines, which have staggered cartridges in series. Thus, longer and straighter magazines, which are used particularly for combat shooting because load jamming is substantially reduced, can be employed as easily as curved magazines.

It is understood of course that the foregoing description of the present invention is provided by way of example only and further modifications and variations can be effected by one skilled in the art without departing from the spirit and scope of the invention, which is to be determined solely by the appended claims.

I claim:

1. A reversible release magazine holder and cartridge magazine system for a firearm having a handle and magazine, in which the magazine holder is arranged in an opening in the handle of the firearm transversely to a longitudinal axis of the magazine and transversely to the axis of a barrel of the firearm and which can be moved in said opening from a retain position to a release position by pressure thereon by the firearm user, and in which at least one recess is present in the cartridge magazine to cooperate with the magazine holder, said magazine holder comprising a unitary, one-piece, substantially cylindrical, latch element having a concave recessed portion formed therein with a curve adapted to a corresponding curved surface of the cartridge magazine, the concave recessed portion being substantially cylindrical and having an axis parallel to a longitudinal axis of the cartridge magazine, and having two stop shoulders extending into said concave recessed portion parallel to a longitudinal axis of said latch element, said opening having two ends and being adapted to receive said latch element from either end, and in which the cartridge magazine further comprises two pairs of slot-like recesses in said curved surface, one pair of said slot-like recesses cooperating with said two stop shoulders when said latch element is inserted in one end of said opening and the magazine is inserted into said firearm and the other pair of said slot-like recesses cooperating with said stop shoulders when said latch element is inserted into the other end of said opening.

2. A magazine holder and cartridge magazine system according to claim 1, in which said two stop shoulders formed in said latch element are arranged to be substantially symmetrical to a central plane of said latch element.

3. A magazine holder and cartridge magazine system according to claim 2, in which said stop shoulders are separated one from another by a groove having sidewalls arranged substantially parallel one to another and to said central plane and a groove base being curved in the form of said concave recessed portion, and wherein outside surfaces of said two stop shoulders are concavely curved.

4. A magazine holder and cartridge magazine system according to claim 3, in which said stop shoulders are separated one from another by a groove having sidewalls arranged substantially parallel to one another and to a central plane of said latch element and a groove base being curved in the form of said concave recessed portion, and wherein outside surfaces of said two stop shoulders are concavely curved.

5. A magazine holder and cartridge magazine system according to claim 1, in which said latch element is a cylinder of substantially elliptical cross-section and in which said concave recessed portion is formed of two circular cylindrical surfaces connected by a substantially flat plane at an innermost point of said concave recessed portion and in which said substantially flat plane is parallel to the longitudinal axis of said latch element.

6. A magazine holder and cartridge magazine system according to claim 1, in which said holder further comprises an axial bore formed in said latch element in a portion thereof not occupied by said concave recessed portion, a coil spring arranged in said bore, and a support plate arranged to close one of said ends of said opening in the handle of the firearm, said support plate being arranged for abutment there against by said coil spring.

7. A magazine holder and cartridge magazine system according to claim 6, further comprising a retaining element arranged in said latch element for limiting travel of said latch element along said opening, said retaining element including a detent means arranged in a radial bore in said latch element, a coil spring for biasing said detent means radially outwardly relative to said latch element, and a slot formed in said handle of said firearm for engagement with said detent means when said latch element resides within said opening.

8. A magazine holder and cartridge magazine system according to claim 7, in which said detent means further includes a stop surface arranged substantially perpendicularly to the longitudinal axis of said latch element for abutting against a wall of said slot and further including a support surface arranged at an angle relative to said stop surface of said detent means.

9. A magazine holder and cartridge magazine system according to claim 3, in which said holder further comprises an axial bore formed in said latch element in a portion thereof not occupied by said concave recessed portion, a coil spring arranged in said bore, and a support plate arranged to close one of said ends of said opening in the handle of the firearm, said support plate being arranged for abutment there against by said coil spring.

* * * * *